US009039577B2

(12) United States Patent
Peng

(10) Patent No.: US 9,039,577 B2
(45) Date of Patent: May 26, 2015

(54) ELLIPTICAL TRAINER

(71) Applicant: Jing-Yuan Peng, Taipei (TW)

(72) Inventor: Jing-Yuan Peng, Taipei (TW)

(73) Assignee: MARIO CONTENTI DESIGNS CO., LTD., Hsinchu (TW)

( * ) Notice: Subject to any disclaimer, the term of this patent is extended or adjusted under 35 U.S.C. 154(b) by 97 days.

(21) Appl. No.: 13/918,386

(22) Filed: Jun. 14, 2013

(65) Prior Publication Data

US 2014/0371032 A1 Dec. 18, 2014

(51) Int. Cl.
*A63B 22/04* (2006.01)
*A63B 22/06* (2006.01)

(52) U.S. Cl.
CPC ..... *A63B 22/04* (2013.01); *A63B 22/0664* (2013.01); *A63B 2022/0676* (2013.01)

(58) Field of Classification Search
CPC ..... A63B 22/001; A63B 22/0664; A63B 21/225; A63B 2022/0676; A63B 2022/067; A63B 2022/206; A63B 22/0015; A63B 22/04
USPC ..... 482/51, 52, 57, 62
See application file for complete search history.

(56) References Cited

U.S. PATENT DOCUMENTS

| | | | | |
|---|---|---|---|---|
| 5,865,712 | A * | 2/1999 | Chang | 482/57 |
| 6,077,198 | A * | 6/2000 | Eschenbach | 482/52 |
| 6,210,305 | B1 * | 4/2001 | Eschenbach | 482/52 |
| 6,905,442 | B1 * | 6/2005 | Lee et al. | 482/52 |
| 2007/0072742 | A1 * | 3/2007 | Chen | 482/52 |
| 2014/0243157 | A1 * | 8/2014 | Huang et al. | 482/52 |

* cited by examiner

*Primary Examiner* — Stephen Crow
(74) *Attorney, Agent, or Firm* — Egbert Law Offices, PLLC

(57) ABSTRACT

An elliptical treadmill has a main framework, guiding wheel set, rocker bar, upper connecting rod, pedal assembly and a crank set. Of which, the crank sets are fitted with first and second swinging arms arranged in pair at interval. The top of the first and second swinging arms is fixed by two pin joint members separately onto preset spaced locations of the upper connecting rod. The bottom of said first swinging arm is pivoted on the front side of the pedal linked to the lower connecting rod, while the bottom of said second swinging arm is pivoted on the rear side of the pedal. When the upper connecting rod shifts circumferentially along the rotary guiding wheel, the first and second swinging arms could swing by taking the pin joint member as a rotary pivot, increasing the swinging range and the step pitch during rotary shift of the pedal assembly.

3 Claims, 8 Drawing Sheets

ELLIPTICAL TRAINER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an elliptical trainer, and more particularly to an innovative one which enables to increase the swinging range and step pitch.

2. Description of Related Art Including Information Disclosed Under 37 CFR 1.97 and 37 CFR 1.98.

Given that people nowadays are often busy with work but find no time to engage in outdoor sports, a variety of indoor fitness equipments, e.g.: treadmills, rowing devices or elliptical treadmills, are developed in response to such demands. So, the present invention intends to make some breakthrough improvement for one of co on fitness equipments, i.e.: typical elliptical treadmill.

As for a typical elliptical trainer, its pedal is forced to conduct elliptical cyclic motion, so the users could simulate the walking trajectory of the feet for desired fitness effect when stepping on the pedal. Yet, the actual effects of sports could not be met with such typical elliptical trainers, since its pedal is often directly linked by a single connecting rod, the maximum step pitch (distance between front and rear ends of motion) must be limited by the swinging range of the connecting rod, leading to smaller step pitch and insufficient amplitude with much poorer sports effect and applicability of the product. Hence, there is still a big room for design improvement of typical elliptical trainers.

Thus, to overcome the aforementioned problems of the prior art, it would be an advancement if the art to provide an improved, structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

The present invention of an elliptical trainer comprises a main framework, guiding wheel set, rocker bar, upper connecting rod, pedal assembly and crank set. When the upper connecting rod shifts circumferentially along the rotary guiding wheel, the first and second swinging arms of the crank set permit to increase the swinging range and step pitch of the pedal assembly via the swinging distance, thus improving greatly the motion amplitude, the effects of sports and applicability of the product to meet the customer demands.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
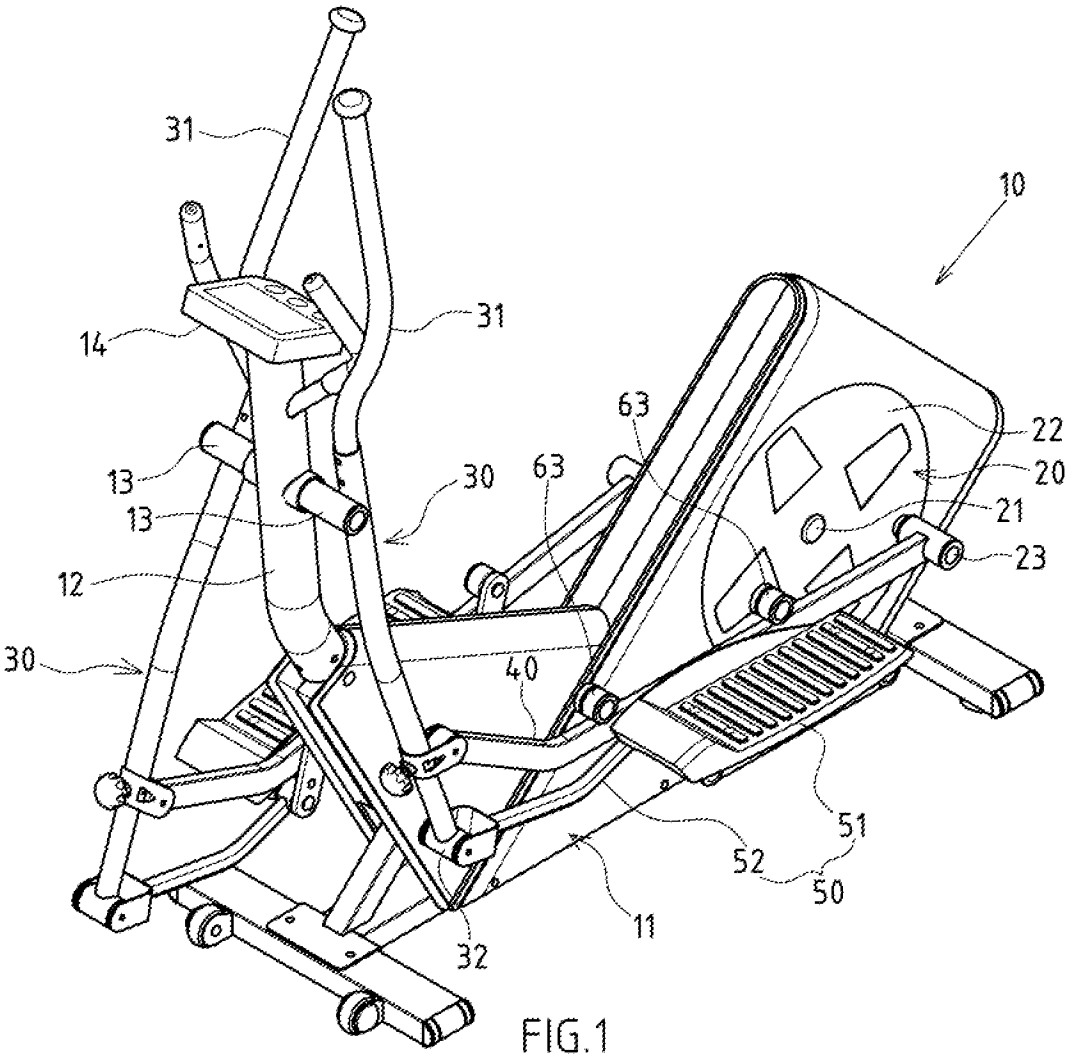
FIG. 1 is a perspective view of the present invention.

FIGS. 1-5 depict preferred embodiments of the elliptical treadmill of the present invention, which, however, are provided for only explanatory objective.

Said elliptical trainer comprises a main framework 10 having of a pedestal 11, a vertical stand 12 vertically arranged at the front of the pedestal 11, and two support arms 13 set transversely at preset location of the vertical stand 12. In the preferred embodiment, a control panel 14 is installed on top of the vertical stand 12.

A guiding wheel set 20 is pivoted by a pin joint assembly 21 onto one end of the pedestal 11 opposite to the vertical stand 12. Said guiding heel set 20 comprises of a rotary guiding wheel 22 and a connecting portion 23 protruded at the preset location of the rotary guiding wheel 22.

Two rocker bars 30 are assembled onto two support arms 13 of the vertical stand 12 on the main framework 10. Handles 11 are formed on the to of the rocker bar 10, and pin joint portions 32 are arranged at the bottom. The middle of the rocker bar 30 is assembled onto the support arm 13, such that two rocker bars 30 could swing by taking the support arm 13 as a rotary pivot.

Two upper connecting rods 40 have rear ends pivoted onto the connecting portion 23 of the rotary guiding wheel 22, and the front ends connected with the rocker bar 30.

Two pedal assemblies 50 are provided and comprise of a pedal 51 and a lower connecting rod 57. Of which, the rear end of the lower connecting rod 52 is linked to the front side of the pedal 51, and the front end of the lower connecting rod 52 is pivoted onto the pin joint portion 32 at bottom of the rocker bar 30. When the rocker bar 30 is activated, the upper and lower connecting rods 40, 52 could be linked simultaneously, such that the rear end of the upper connecting rod 40 could shift circumferentially along the rotary guiding wheel 22, and the lower connecting rod 52 could drive the pedal 51 to move rotarily on an elliptical path. Two crank sets 60, fitted with first and second swinging arms 61, 62 are arranged in pair at interval. The top of the first and second swinging arms 61, 62 is fixed by two pin joint members 63 separately onto preset spaced locations of the upper connecting, rod 40 (said pin joint member 63 refers to a bearing, which is welded onto preset spaced locations of the upper connecting rod 40). The bottom of said first swinging arm 61 is pivoted, on the front side of the pedal 51 linked to the lower connecting rod 52, while the bottom of said second swinging arm 62 is pivoted on the rear side of the pedal 51. When the upper connecting rod 40 shifts circumferentially along the rotary guiding wheel 22, the first and second swinging arms 61, 62 could swing by taking the pin joint member 63 as a rotary pivot. Based on the swinging distance of the first and second swinging arms 61, 62, this could increase the swinging range and the step pitch during rotary shift of the pedal assembly 50.

Figure 2:
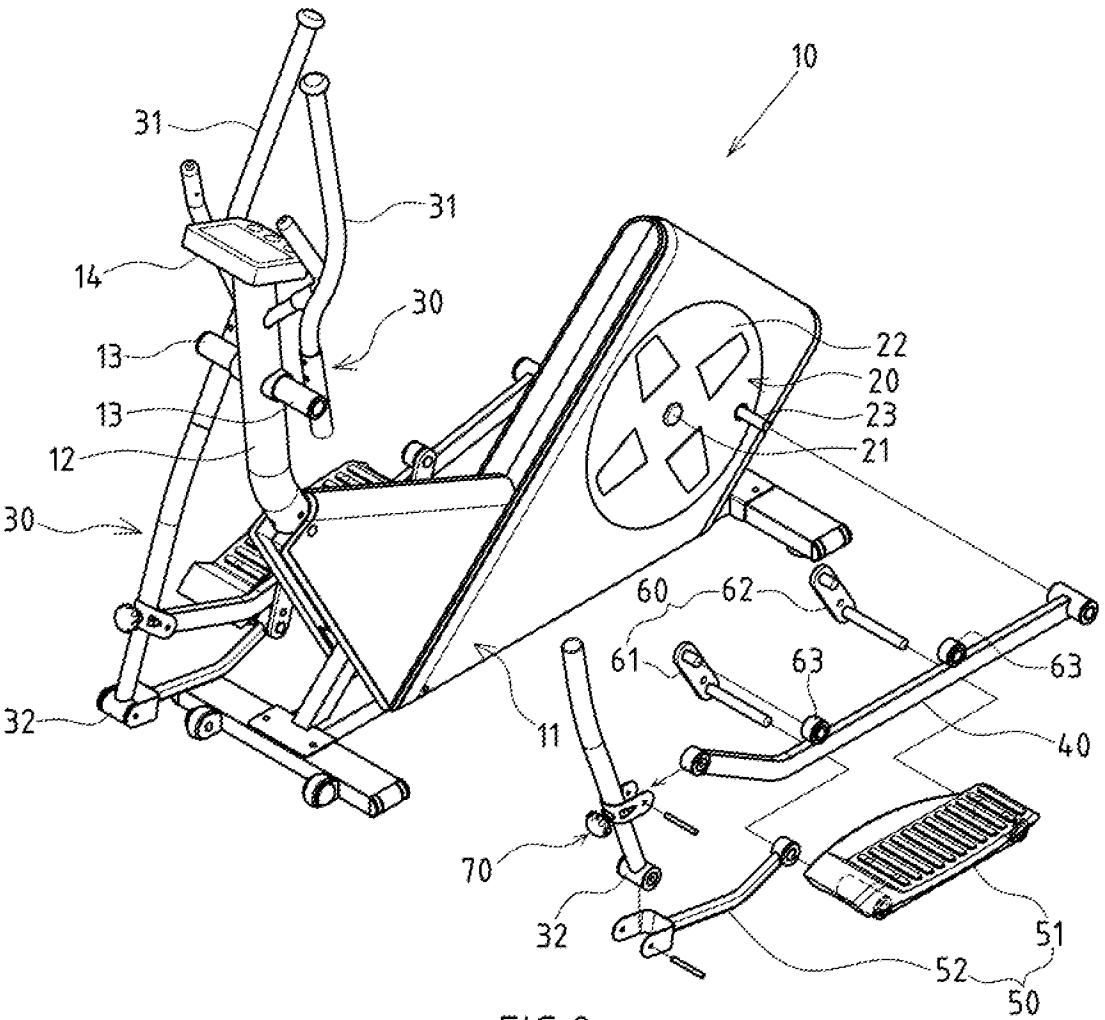
FIG. 2 is an exploded perspective view of the present invention.
Figure 3:
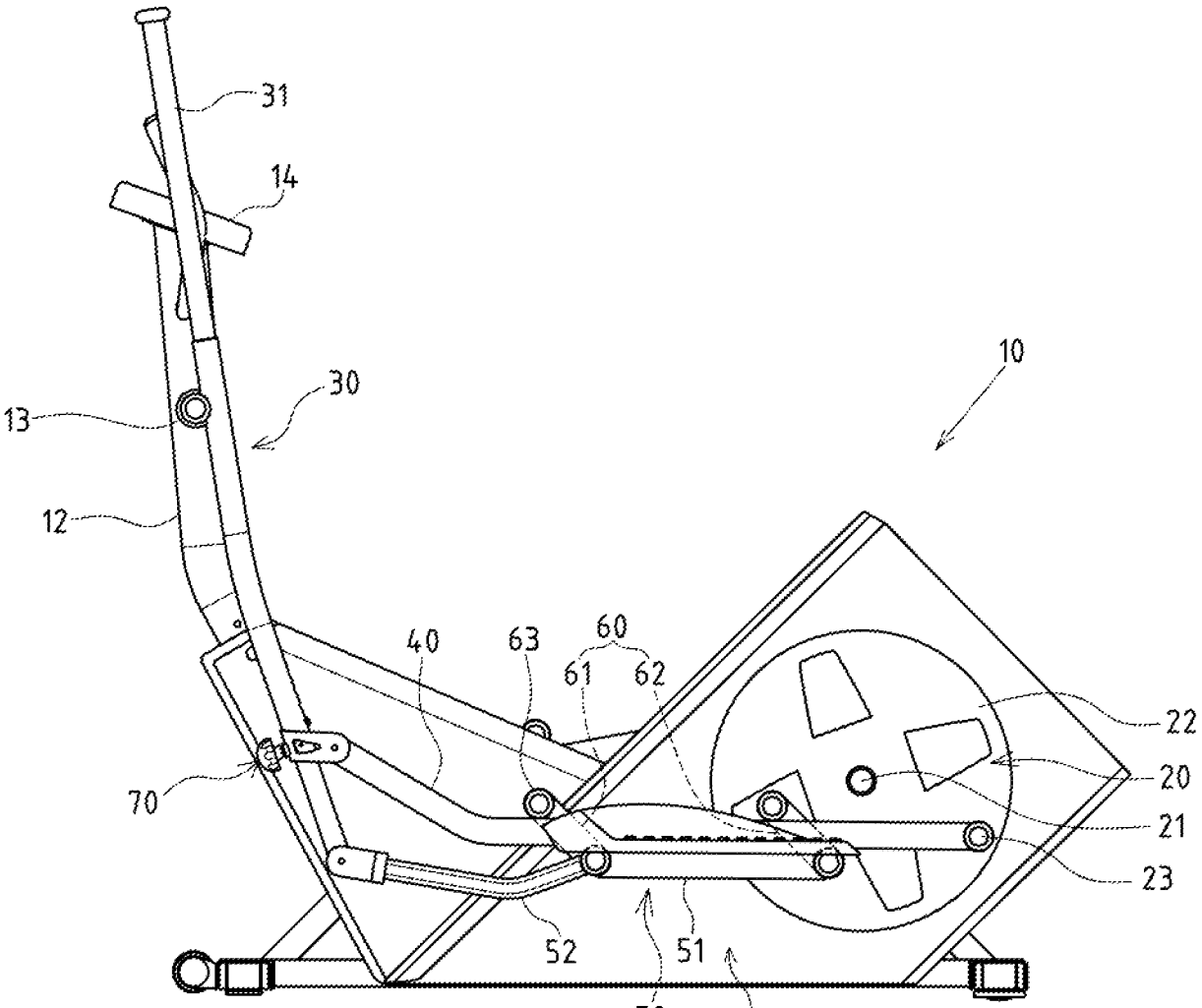
FIG. 3 is a plane view of the present invention.
Figure 4:
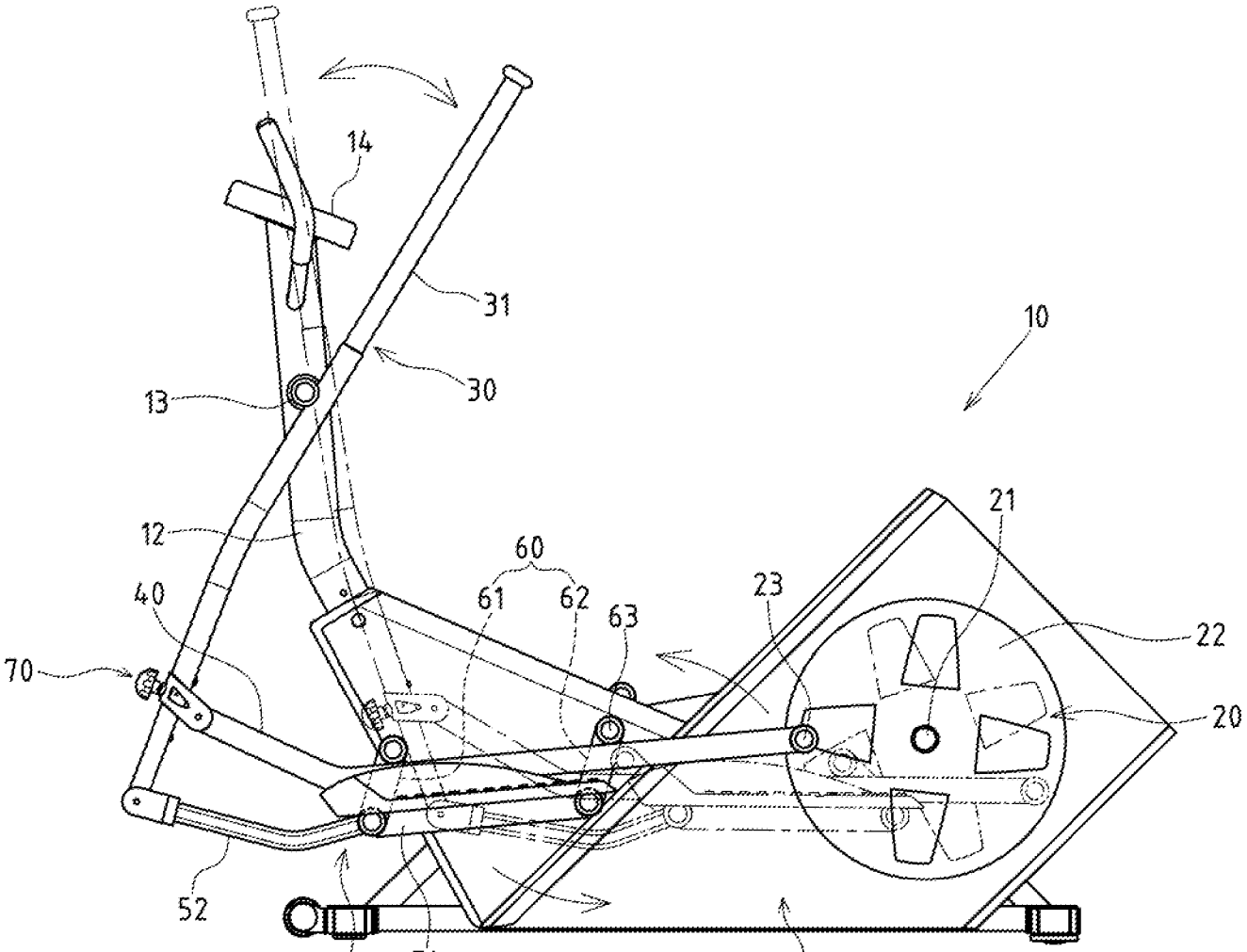
FIG. 4 is a schematic view showing the actuating state of the present invention.

Referring to FIGS. 2, 4 for the preferred embodiments of the present invention, the first and second swinging arms 61, 62 of the crank set 60 are designed into an elongated board pattern, and arranged in parallel. In such a case, when the upper connecting rod 40 shifts circumferentially along the rotary guiding wheel 22, the first and second swinging arms 61, 62 could swing towards the front or rear of the pedestal 11 by taking the pin joint member 63 as a rotary pivot. Moreover, based on the swinging distance of the first and second swinging arms 61, 62, this could increase the swinging range and the step pitch during rotary shift of the pedal assembly 50.

Figure 5:
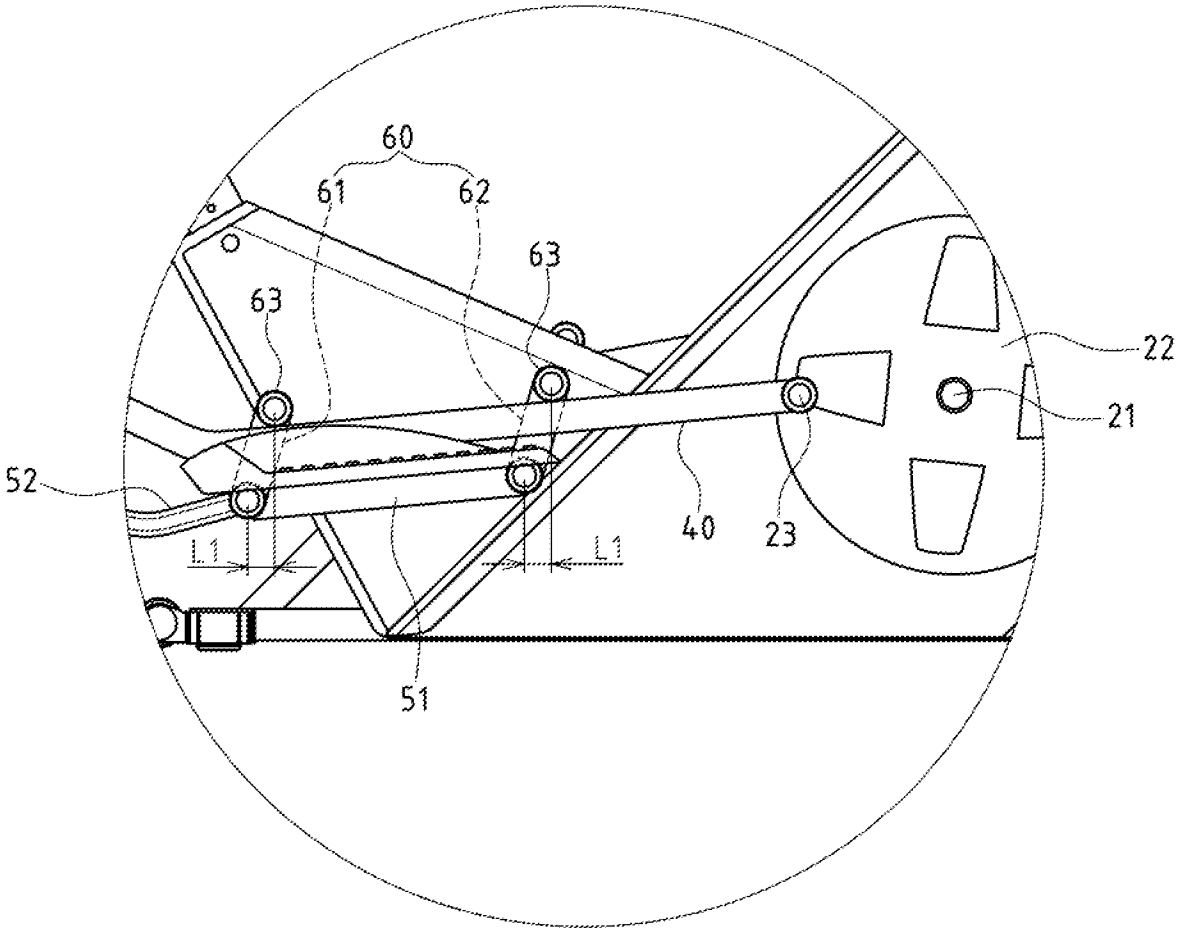
FIG. 5 is a partially enlarged view of the present invention wherein the step pitch is increased by the crank set.

Referring to FIG. 5, when the first and second swinging antis 61, 62 swing towards the front of the pedestal 11, the pedal assembly 50 could be pulled forwards, thus increasing the step pitch (marked by arrow L1) of the pedal assembly 50 based on the length and swinging distance of the first and second swinging arms 61, 62.

Figure 6:
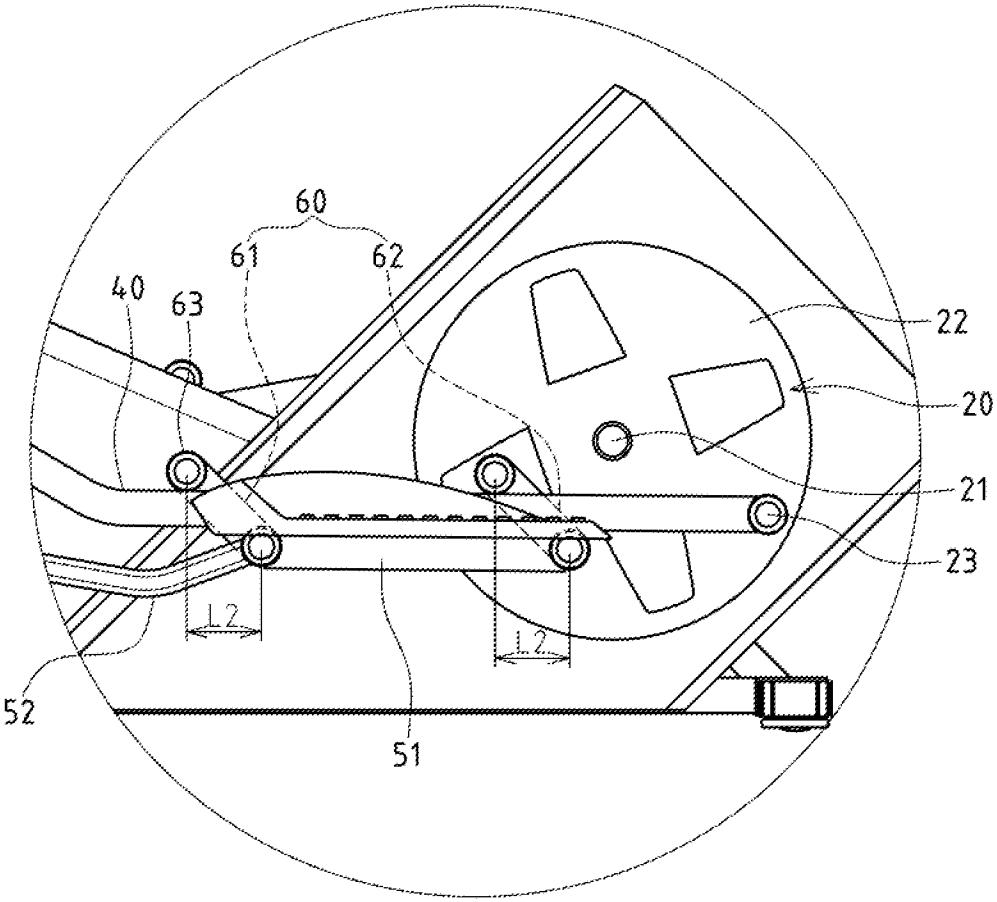
FIG. 6 is a partially enlarged view of the present invention wherein the step pitch is increased by the crank set.

Referring also to FIG. 6, when the first and second swinging arms 61, 62 swing towards the rear of the pedestal 11, the pedal assembly 50 could also be pulled backwards, thus increasing the step pitch (marked by arrow L2) of the pedal assembly 50. When the upper connecting rod 40 shifts circumferentially along the rotary guiding wheel 22, this could increase substantially the swinging amplitude of the pedal assembly 50 and improve markedly the sports effect, applicability of the product to meet the customer demands based on the length and swinging distance of the first and second swinging arms 61, 62.

Figure 7:
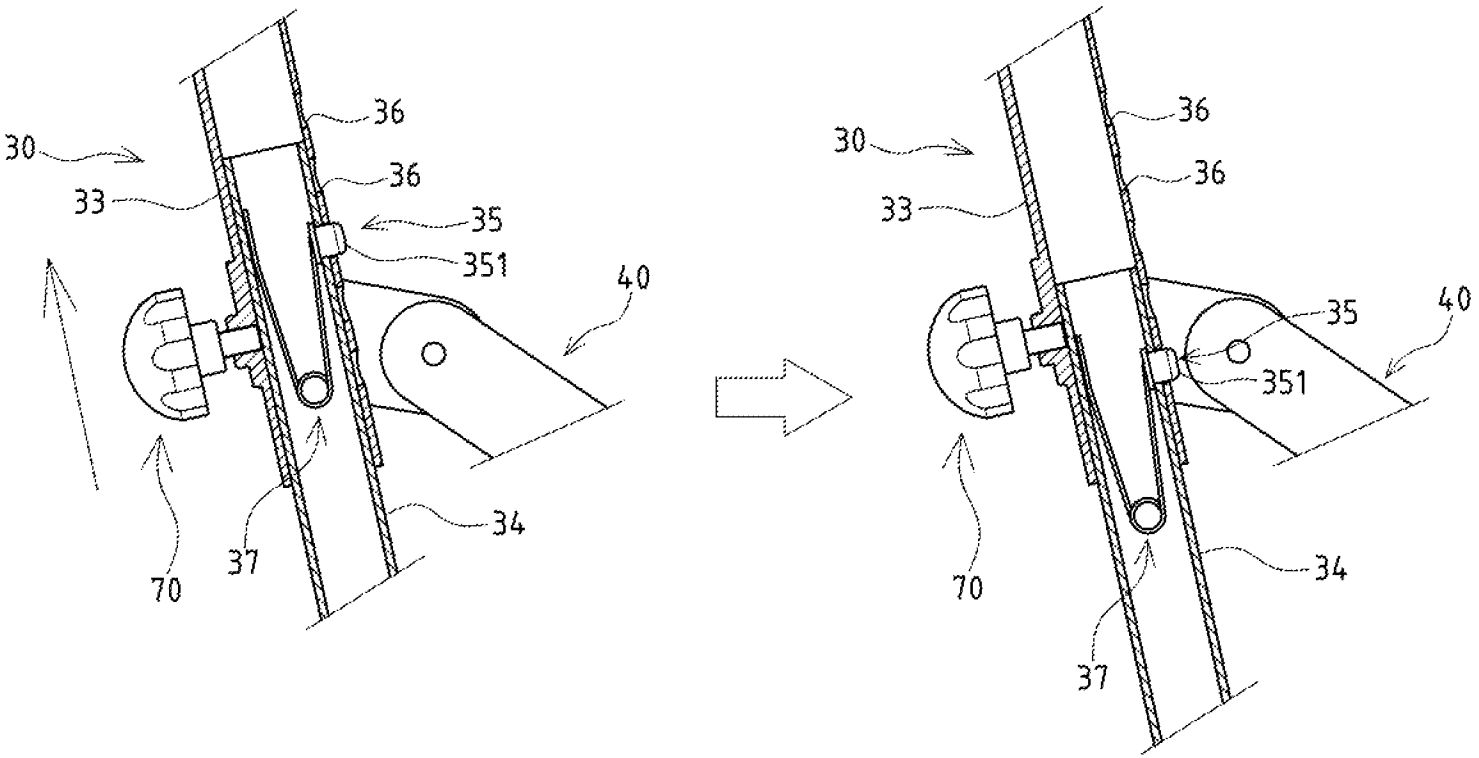
FIG. 7 is a sectional view of another preferred embodiment of the present invention.

Referring to FIG. 7, the lower part of the rocker bar 30 is designed into an adjustable lifting state, so as to define an outer tube 33, an inner tube 34 inserted into the outer tube 33 in an adjustable lifting state and a release locator 35 set into the inner tube 34. Multiple locating holes 36 are arranged vertically at interval are opened at one side of the outer tube 33. Besides, an abutting end 351 of the release locator 35 could be mated securely with any locating hole 36 of the outer tube 33, and the release locator 35 is normally protruded and locked by an elastic member 37 at one side of the release locator 35. When the release locator 35 is pressed into an adjustable retraction state (namely, when the release locator 35 is pressed, the inner tube 34 could lift adjustably within the outer tube 33), the position of the pedal assembly 50 could be changed by adjusting the position of the inner tube 34, thus increasing the swinging range and step pitch of the pedal assembly 50. Of which, an auxiliary locator 70 is set at the joint of the upper connecting rod 61 and rocker bar 30, and used to assist in locating the adjustable position of the inner tube 34. In the preferred embodiment, the auxiliary locator 70 is bolted onto the outer tube 33 and abutted onto the inner tube 34 to a certain extent by tightening or loosening the auxiliary locator 70.

Figure 8:
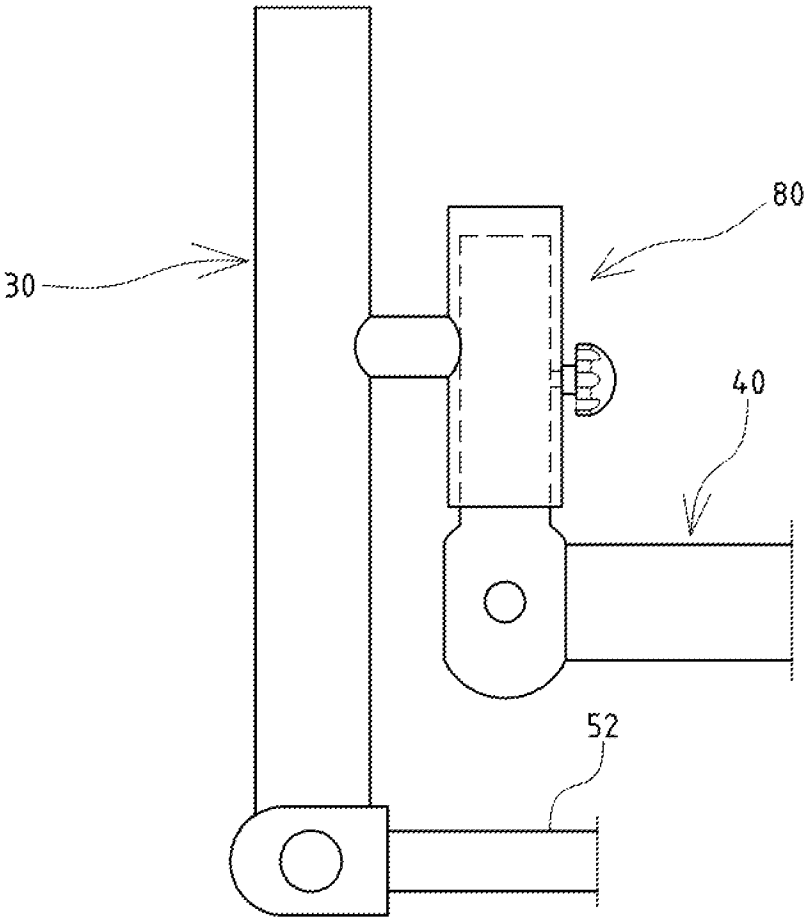
FIG. 8 is a partial schematic view of another preferred embodiment of the present invention.

Referring also to FIG. 8, a sleeving assembly 80 is set at a preset location underneath the rocker bar 30. One end of the upper connecting rod 40 is pivoted, into the sleeving assembly 80 in a freely slidable state. Hence, the swinging range and step pitch of the pedal assembly 50 could be adjusted and changed accordingly.

I claim:

1. An elliptical trainer, comprising:

a main framework having a pedestal, a vertical stand vertically arranged at a front of the pedestal, and a pair of support arms set transversely at preset locations of the vertical stand;

a guiding wheel set pivoted by a pin joint assembly onto one end of the pedestal opposite the vertical stands, said guiding wheel set having a rotary guiding wheel and a connecting portion protruded at a preset location of the rotary guiding wheel;

a pair of rocker bars assembled onto a pair of support arms of the vertical stand on said main framework, each of said pair of rocker bars having a handle formed at a top thereof, each of said pair of rocker bars having a pin joint portion arranged at a bottom thereof, each of said pair of rocker bars having a middle that is assembled onto the support arm such that the rocker bars can swing by using the support arm as a rotary pivot, a pair of two upper connecting rods having rear ends thereof pivoted onto the connecting portion of the rotary guiding wheel and front ends connected with the rocker bar; and a pair of pedal assemblies each having a pedal and a lower connecting rod, the lower connecting rod being linked to a front side of the pedal, a front end of the lower connecting rod being pivoted onto the pin joint portion connected at a bottom of the rocker bar, the upper and lower connecting rods being linked simultaneously and a rear end of the upper connecting rod shifting circumferentially along said rotary guiding wheel and the lower connecting rod driving the pedal so as to move rotationally along an elliptical path when the rocker bar is attached;

a pair of crank sets fitted with first and second swinging arms arranged in spaced relation, a top of said first and second swinging arms being fixed by a pair of pin joint members separately at preset spaced locations on said upper connecting rod, said first swinging arm having a bottom that is pivoted on a first side of the pedal linked to said lower connecting rod, said second swinging arm having a bottom that is pivoted on a rear side of the pedal, said first and second swinging arms swing about said pin joint member as a rotary pivot when the upper connecting rod shifts circumferentially along said rotary guiding wheel.

2. The elliptical trainer of claim 1, the rocker bar having a lower end with an adjustable lifting state, said rocker bar having an outer tube and an inner tube inserted into said outer tube such that said inner tube is in the adjustable lifting state, said inner tube having a release locator set therein, said outer tube having multiple locating holes arranged in vertically spaced relationship at one side of said outer tube, said release locator having an abutting end that is mateable securely with one of the locating holes, said release locator being normally protruded and locked by an elastic member positioned at one side of said release locator, the upper connecting rod and the rocking bar having a joint to which an auxiliary locator is set, said auxiliary locator adapted to locate the adjustable position of said inner tube.

3. The elliptical trainer of claim 1, said first and second swinging arms being arranged in parallel, said first and second swinging arms swinging toward a front or a rear of said pedestal by using said pin joint member as a rotary pivot when the upper connecting rod shifts circumferentially along said rotary guiding wheel.

* * * * *